United States Patent [19]

Goto

[11] 3,946,350

[45] Mar. 23, 1976

[54] COIL ASSEMBLY FOR BOBBIN WOUND TRANSFORMER

[76] Inventor: Katsuichi Goto, c/o Tokyo Keidenki Kabushiki Kaisha, 4-3, Tamagawa 2 chome, Ota, Tokyo, Japan

[22] Filed: Mar. 26, 1975

[21] Appl. No.: 562,019

[52] U.S. Cl. ..... 336/208; 336/209

[51] Int. Cl.[2] ..... H01F 27/32

[58] Field of Search ..... 336/198, 199, 209, 206, 336/207, 192, 208; 206/53, 412, 391, 398; 242/6, 7.08, 7.09, 166

[56] References Cited

UNITED STATES PATENTS

| | | | |
|---|---|---|---|
| 2,180,420 | 11/1939 | Larsen | 336/206 X |
| 2,214,151 | 9/1940 | Wagar | 336/192 |
| 3,487,347 | 12/1969 | Lepianka | 336/206 X |
| 3,781,741 | 12/1973 | Weiner | 336/198 |

FOREIGN PATENTS OR APPLICATIONS

| | | | |
|---|---|---|---|
| 231,457 | 1/1962 | Netherlands | 336/199 |
| 936,528 | 12/1955 | Germany | 336/208 |
| 71,383 | 10/1942 | Czechoslovakia | 336/198 |
| 25,339 | 7/1956 | Germany | 336/208 |
| 949,161 | 8/1949 | France | 336/208 |

*Primary Examiner*—Thomas J. Kozma

[57] ABSTRACT

A coil assembly for bobbin wound transformer includes a spacer between the end turns of a primary and secondary windings, which spacer is molded from synthetic resin material. The molded spacer includes an inner body portion which covers the surface of the primary winding, and a marginal portion which extends outwardly along the inner sidewall of the flange of the bobbin. The marginal portion sufficiently separates that portion of the outer secondary winding which is disposed along the flange of the bobbin.

5 Claims, 6 Drawing Figures

COIL ASSEMBLY FOR BOBBIN WOUND TRANSFORMER

The invention relates to a coil assembly for bobbin wound transformer, and more particularly to an electrical insulation for providing isolation between the end turns of the primary and secondary windings of the transformer.

A bobbin wound transformer for use in a radio or television receiver and other electronic equipment is formed by initially winding a primary or inner winding on a bobbin, providing an insulating tape over the surface of the primary winding, and subsequently winding the secondary or outer winding. However, the prior tape winding procedure failed to eliminate an electrical failure completely. One of the reasons for this failure is a small clearance left between the insulating tape and the flange of the bobbin, through which the end turn of the outer winding may be forced into the inner winding. Another reason is the difficulty of providing a suitable tape insulation between the inner and outer windings at a position very close to the inner wall of the flange of the bobbin, thus causing an electrical short-circuiting. It is a very cumbersome, if not impossible, operation to provide a firm covering on the outer surface of the inner winding and to wind an insulating tape carefully so as to extend it outwardly from the outer surface of the winding along the inner sidewall of the bobbin flange. In addition, when winding the outer winding, care must be taken so that the portion of the insulating tape which is disposed against the inner sidewall of the flange can not be folded back onto the inner winding.

Therefore, it is an object of the invention to provide a coil assembly for bobbin wound transformer which is provided with a molded spacer assuring a reliable insulation between the inner and outer windings of the transformer.

It is another object of the invention to provide a coil assembly for bobbin wound transformer which can be easily and inexpensively manufactured.

In accordance with the invention, there is provided a coil assembly for bobbin wound transformer which is provided with a spacer molded from a synthetic resin. The spacer includes a body portion which is disposed between an inner and an outer winding concentrically wound on a bobbin having a flange, and a marginal portion disposed between the inner sidewall of the flange and the outer winding. After winding the inner winding on the bobbin, the spacer is mounted thereon so that its body portion covers the inner winding. To permit its mounting, the spacer is provided with a split. In a modification, the spacer comprises a pair of split parts, which can be applied around the inner winding and then joined together for setting up it.

Other objects and features of the invention will become apparent from the following detailed description of several embodiments thereof shown in the attached drawings, in which.

Figure 1:
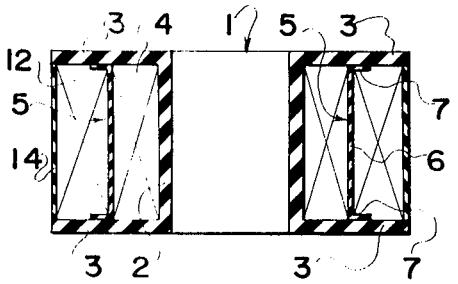
FIGS. 1 to 3 are cross sections of several embodiments of the coil assembly according to the invention.
Figure 2:
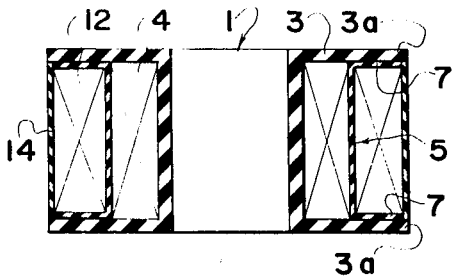
Figure 3:
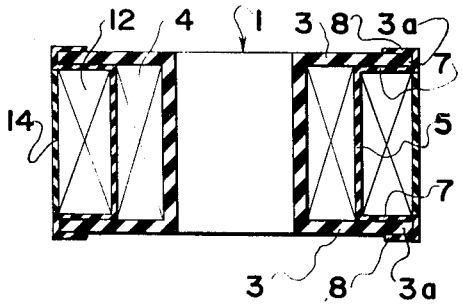
Figure 4:
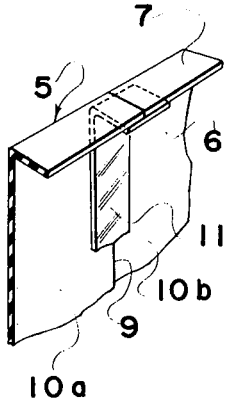
FIGS. 4 and 5 are perspective views illustrating examples of joints in the spacer.
Figure 5:
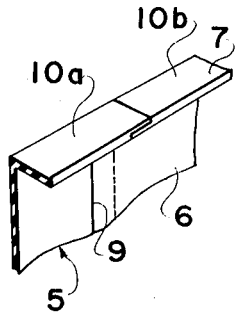

Referring to the drawings, a bobbin wound transformer includes a bobbin 1 having a hollow cylindrical portion 2 which surrounds a core (not shown), and a flange 3 which extends radially outward from the opposite ends of the cylindrical portion 2. An inner winding 4 is initially wound around the cylindrical portion 2, and in accordance with the invention, the surface of its end turns is covered by a molded spacer 5. The spacer 5 includes a body portion 6 which is disposed around the inner winding 4, and a marginal portion 7 which extends radially outward from the opposite ends of the body portion 6 along the inner sidewall of the flange 3 of the bobbin 1. In the arrangement shown in FIG. 1, the marginal portion 7 has a small width, while it extends to the end 3a of the flange 3 of the bobbin 1 in the arrangement shown in FIG. 2. In FIG. 3, the marginal portion 7 extends beyond the end **3*a* of the flange 3 and is folded back onto the outer surface thereof to provide an extension 8 which covers it. The spacer 5 is molded from a flexible and electrically insulating synthetic resin, for example, and has a configuration and size such that the inner surface of the body portion 6 fits around the surface of the inner winding 4. As indicated in FIG. 4, the spacer is formed with an axially extending split 9, which can be utilized to open the spacer in order to mount it on the inner winding 4. After mounting, both edges 10*a*, 10*b* of the spacer 5 defined by the split 9 are brought into abutting engagement with each other, and an adhesive tape 11 is applied on the outer surface of the edges 10*a*, 10*b* (see FIG. 4), thereby bonding the edges together and securing the spacer 5 in position. Alternatively, the edges 10*a*, 10*b* may be formed as complementary steps as shown in FIG. 5. As a further alternative, the spacer 5 may be formed in two parts and joined together in the similar manner as illustrated for the split 9**. In this instance, the spacer may be molded from a thermosetting resin having no appreciable flexibility.

Figure 6:
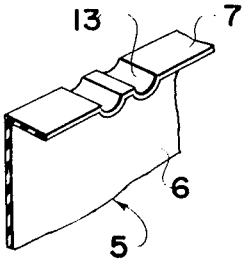
FIG. 6 is a perspective view of a modification of the spacer including grooves for taking out the ends of the inner winding.

When the spacer 5 is mounted in position, an outer winding 12 is wound around the body portion 6. The end turns of the outer winding 12 which are in the first tier are separated from the end turns of the inner winding 4 in the final tier by the body portion 6 of the spacer 5, and the end turns of the outer winding in the subsequent tiers are also protected by the marginal portion 7 of the spacer 5. While the marginal portion 7 has a reduced width in the arrangement of FIG. 1 as compared with those of FIGS. 2 and 3, and its extremity is buried in the outer winding 12, it is still effective to space the portion of the outer winding 12 which is disposed along the flange 3 of the bobbin 1 a sufficient distance from the inner winding 4 to provide an electrical isolation. The lead wires (not shown) can be extended through grooves 13 (FIG. 6) formed in the marginal portion 7 of the spacer 5 to the exterior of the coil assembly. The final tier of the outer winding 12 can be protected by a known tape insulation 14.

It will be appreciated that in accordance with the invention, the outer winding 12 can be wound on the inner winding 4 immediately after the spacer 5 is mounted on the surface of the inner winding, without requiring the care and skill excerised in the prior practice in providing a tape insulation, thus facilitating a winding operation.

Having described the invention, what is claimed is:

1. A coil assembly for a bobbin wound transformer comprising in combination: a bobbin having a hollow cylindrical body and a pair of radially extending flanges at the axially opposed ends of said body; an inner coil winding wound around said bobbin body; a molded substantially rigid spacer member of synthetic resin mounted on said bobbin and positioned concentrically on said bobbin body in overlying electrically insulated relation to said inner coil winding and a pair of radially extending flanges integral with the spacer member at the axially opposed ends thereof, the flanges of said spacer member being juxtaposed in parallel contiguous relation to and axially inwardly of said bobbin flanges; and an outer coil winding wound around said spacer member concentric to said inner coil winding and insulated therefrom by said spacer member, said spacer member comprises complementary sections having axially extending edges which are forced together to secure the spacer member on said bobbin body.

2. A coil assembly according to claim 1 in which said radially extending flanges of the bobbin and spacer member terminate at substantially the same radial location.

3. A coil assembly according to claim 1 in which the radial flanges of said spacer member extend beyond the radial flanges of said bobbin and are turned outwardly so as to cover the radial extremities of said bobbin flanges.

4. A coil assembly according to claim 1 in which the edges are joined together after the spacer is mounted on the inner winding.

5. A coil assembly according to claim 1 in which the spacer member comprises a pair of semi-cylindrical sections.

* * * * *